US005964690A

United States Patent [19]

Wright et al.

[11] Patent Number: 5,964,690

[45] **Date of Patent: *Oct. 12, 1999**

[54] MECHANISM FOR FIXING A BLOOD CENTRIFUGE BOWL TO A ROTATING SPINDLE

[75] Inventors: David W. Wright, Littleton; Mark T. Patton; Lee W. Travis, both of Denver, all of Colo.

[73] Assignee: Medtronic, Inc., Minneapolis, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/820,201

[22] Filed: Mar. 19, 1997

[51] Int. Cl.[6] ..... B04B 15/00

[52] U.S. Cl. ..... 494/12; 494/84; 279/51; 279/131

[58] Field of Search ..... 494/12, 38, 41, 494/43, 84, 85; 279/51, 131; 269/21

[56] References Cited

U.S. PATENT DOCUMENTS

| | | | |
|---|---|---|---|
| 1,385,306 | 7/1921 | Clayton . | |
| 3,317,127 | 5/1967 | Cole . | |
| 3,581,981 | 6/1971 | Latham, Jr. . | |
| 3,706,412 | 12/1972 | Latham, Jr. . | |
| 3,785,549 | 1/1974 | Latham, Jr. . | |
| 4,684,361 | 8/1987 | Feldman et al. | 494/41 |
| 4,692,136 | 9/1987 | Feldman et al. | 494/38 |
| 4,718,888 | 1/1988 | Darnell | 494/85 |
| 4,767,396 | 8/1988 | Powers . | |
| 4,795,419 | 1/1989 | Yawn | 494/84 |
| 4,838,849 | 6/1989 | Calari | 494/12 |
| 4,900,298 | 2/1990 | Langley . | |
| 5,062,826 | 11/1991 | Mantovani et al. | 494/12 |
| 5,360,542 | 11/1994 | Williamson, IV et al. . | |
| 5,591,113 | 1/1997 | Darnell et al. | 279/131 |
| 5,658,231 | 8/1997 | Schmitt et al. | 279/131 |

FOREIGN PATENT DOCUMENTS

| | | |
|---|---|---|
| 0 278 381 B1 | 8/1988 | European Pat. Off. . |
| 0408022 | 1/1991 | European Pat. Off. . |
| 0769326 | 4/1997 | European Pat. Off. . |
| 1092674 | 2/1978 | Italy . |
| 1150038 | 4/1985 | U.S.S.R. . |
| 9114493 | 10/1991 | WIPO . |

*Primary Examiner*—Charles E. Cooley
*Attorney, Agent, or Firm*—Harold R. Patton

[57] ABSTRACT

A mechanism for fixing a blood centrifuge bowl to a rotating spindle is disclosed having two parts. The first part converts downward movement of an outer collar of a chuck into inward and downward pressure against a blood bowl to be secured in the chuck. The second part of the invention converts centrifugal forces present in a rotating chuck into downward pressure on the collar described above. In the preferred embodiment of the invention, the chuck comprises a base plate, plungers, a finger ring and a collar. The base plate receives and positions the blood bowl. The finger ring has a series of fingers located around its upper periphery that pivot around living hinges into contact with the blood bowl. The collar has an annular sloping finger contacting surface that contacts the outer surface of the fingers and forces them inward and downward into contact with the blood bowl. The base plate has a series of outwardly directed bores that hold plungers. Under rotation of the chuck, the plungers move outward in the bores under centrifugal force and contact a sloped plunger contacting surface on the inner surface of the collar. As the centrifugal force increases, the pressure exerted on the plunger contacting surface by the outer ends of the plungers increase causing the collar to be pressured to move downward. Downward pressure on the collar is translated into downward pressure on the finger contacting surface which in turn is translated into inward and downward pressure on the blood bowl.

92 Claims, 12 Drawing Sheets

MECHANISM FOR FIXING A BLOOD CENTRIFUGE BOWL TO A ROTATING SPINDLE

BACKGROUND OF THE INVENTION

FIELD OF THE INVENTION

The invention relates to a device for attaching a bowl to a rotating spindle and more specifically relates to a device for fixing a blood centrifuge bowl to a rotating spindle.

DESCRIPTION OF THE RELATED ART

Blood processing systems and diagnostic hemostasis management systems for the operating room often use centrifuge devices to separate blood components. The separation of blood components is accomplished by introducing the blood into a blood bowl that is rapidly spun in a centrifuge device.

Blood processing systems typically recover and wash red blood cells and separate and hold other beneficial blood components, such as platelets and plasma, for later reinfusion. Platelets and plasma may also be used to make "platelet gel," which can be applied to surgical wounds to reduce bleeding.

One type of blood processing systems is an autologous blood transfusion device. Autologous blood transfusion devices rapidly collect, clean and separate the patient's own blood, known as autologous blood, into blood components and then reinfuse the desired blood components into the patient. Autologous blood transfusion reduces or eliminates a patient's dependence on blood donated by others, thereby reducing concerns about transmission of bloodborne diseases. One example of an autologous blood transfusion device is the Sequestra 1000 system sold by Medtronic-Electromedics in Parker, Colo.

One approach to attaching a blood bowl to a rotating chuck has been to provide a chuck with radially, axially, inwardly moving dogs that move inwardly to grasp the blood bowl and thereby hold it in place. One problem with this approach is that a secondary tool is needed to actuate the inward and outward motion of the dogs. Another problem with this approach is that the dogs concentrate the clamp force at the dogs. Since there are relatively few dogs, there are relatively few clamp points. This results in increased stress on the blood bowl at each clamp point which is a potential cause of bowl failure. Examples of devices incorporating this type of chuck are the Model ELMD 500 and the Model AT 1000 cell-separating devices sold by Medtronic-Electromedics in Parker, Colo.

Other designs for devices for holding blood bowls in a centrifuge device are known. One such device is shown in U.S. Pat. No. 5,851,169 entitled "ROTARY PLATE AND BOWL CLAMP FOR BLOOD CENTRIFUGE" which patent is commonly assigned with the present application. In this device, the chuck includes a ring that opens at one point to allow insertion of the blood bowl. The ring is then brought together contacting at least a portion of the blood bowl and securing the blood bowl within the chuck.

One problem with this type of chuck is the large number of parts needed and the possibility of having an asymmetric chuck. An asymmetric chuck produces a moment of inertia for the chuck and blood bowl that is not aligned with the axis of rotation of the chuck and blood bowl. This misalignment of the axis of rotation and the moment of inertia causes unnatural stresses on the bearing controlling the rotation of the device. This misalignment may also cause a wobble in the rotation of the chuck and blood bowl. All of these undesirable characteristics of this type of system are preferably to be avoided.

SUMMARY OF THE INVENTION

A mechanism for fixing a blood centrifuge bowl to a rotating spindle is disclosed. In its broadest aspect, the invention has two parts. The first part converts downward movement of an outer collar of a chuck into inward and downward pressure against a blood bowl to be secured in the chuck. This inward and downward pressure secures the blood bowl in the chuck. The second part of the invention converts centrifugal forces present in a rotating chuck into downward pressure on the collar described above. This downward pressure on the collar is converted into inward and downward pressure against the blood bowl to be secured in the chuck.

In the preferred embodiment of the invention, the chuck comprises a base plate, plungers, a finger ring and a collar. The base plate receives and positions the blood bowl. The finger ring has a series of fingers located around its upper periphery that pivot around living hinges. The collar has an annular sloping finger contacting surface that contacts the outer surface of the fingers. The annular sloping finger contacting surface slopes outwardly moving down the sloping surface so that downward movement of the collar causes inward pressure on the fingers.

The collar also has an annular sloping plunger contacting surface that contacts the outer ends of the plungers. The annular sloping plunger contacting surface slopes inwardly moving down the sloping surface so that outer pressure on the plunger contacting surface causes downward pressure on the collar.

The base plate preferably has a series of outwardly directed bores that hold plungers. Under rotation of the chuck, the plungers move outward in the bores under centrifugal force. The outer ends of the plungers contact the plunger contacting surface. As the centrifugal force increases, the pressure exerted on the plunger contacting surface by the outer ends of the plungers increase. The increasing pressure applied to the plunger contacting surface by the outer ends of the plungers causes the collar to be pressured to move downward. The downward pressure on the collar is translated into downward pressure on the finger contacting surface which in turn is translated into inward and downward direct pressure on the blood bowl.

The many fingers of the present invention grip the blood bowl at many different locations around the circumference of the blood bowl. This spreads out and distributes the pressure exerted on the blood bowl by the fingers to a substantially the entire circumferential surface. By contrast, chucks having fewer bowl contacting pieces concentrate the gripping pressure over a few areas thereby producing increased pressure in these areas. As a result, in the present system, if a blood bowl has a geometric irregularity in or near the area of contact of the blood bowl, the pressure applied to the blood bowl in the area of the irregularity would be less than if there were fewer blood bowl contacting pieces.

It is the primary object of the invention to provide a device for fixing a blood centrifuge bowl to a rotating spindle that is simple to manufacture and easy to use.

It is a further object of the invention to provide a device for fixing a blood centrifuge bowl to a rotating spindle is inherently balanced.

It is a further object of the invention to provide a device for fixing a blood centrifuge bowl to a rotating spindle that eliminates the need for dynamic balancing.

It is another object of the present invention to provide a device for fixing a blood centrifuge bowl to a rotating spindle that eliminates the need for a secondary tool to actuate the chuck.

It is another object of the invention to provide a device for fixing a blood centrifuge bowl to a rotating spindle that is self-locking during loading.

It is another object of the invention to provide a device for fixing a blood centrifuge bowl to a rotating spindle that uses the centrifugal force present in a centrifuge operation to lock the blood centrifuge bowl to the rotating spindle.

It is another object of the invention to provide a device for fixing a blood centrifuge bowl to a rotating spindle that has a low rotational inertia.

It is a further object of the invention to provide a device for fixing a blood centrifuge bowl to a rotating spindle that accommodates irregularities in the blood bowl geometry.

These and other objects of the invention will be clear from the following detailed description of the invention and in particular with reference to the attached drawings. In the attached drawings, like elements, wherever referred to, are referred as like reference numbers.

Throughout this description, reference is made to "upper", "lower", "inner" and "outer" as well as to moving "upwardly", "downwardly", "inwardly" and "outwardly". "Upper" surfaces are those generally directed toward the label "A" in FIG. 1 while "lower" surfaces are those generally directed toward the label "B" in FIG. 1. "Inner" means generally being closer to central axis 32 while "outer" means generally being farther away from central axis 32.

Movement "upward" or "upwardly" is movement generally toward "A" while movement "downward" or "downwardly" is movement generally toward "B". Movement "inward" or "inwardly" is movement generally toward central axis 32. Movement "outward" or "outwardly" is movement generally away from central axis 32.

DETAILED DESCRIPTION OF THE INVENTION

Figure 1:
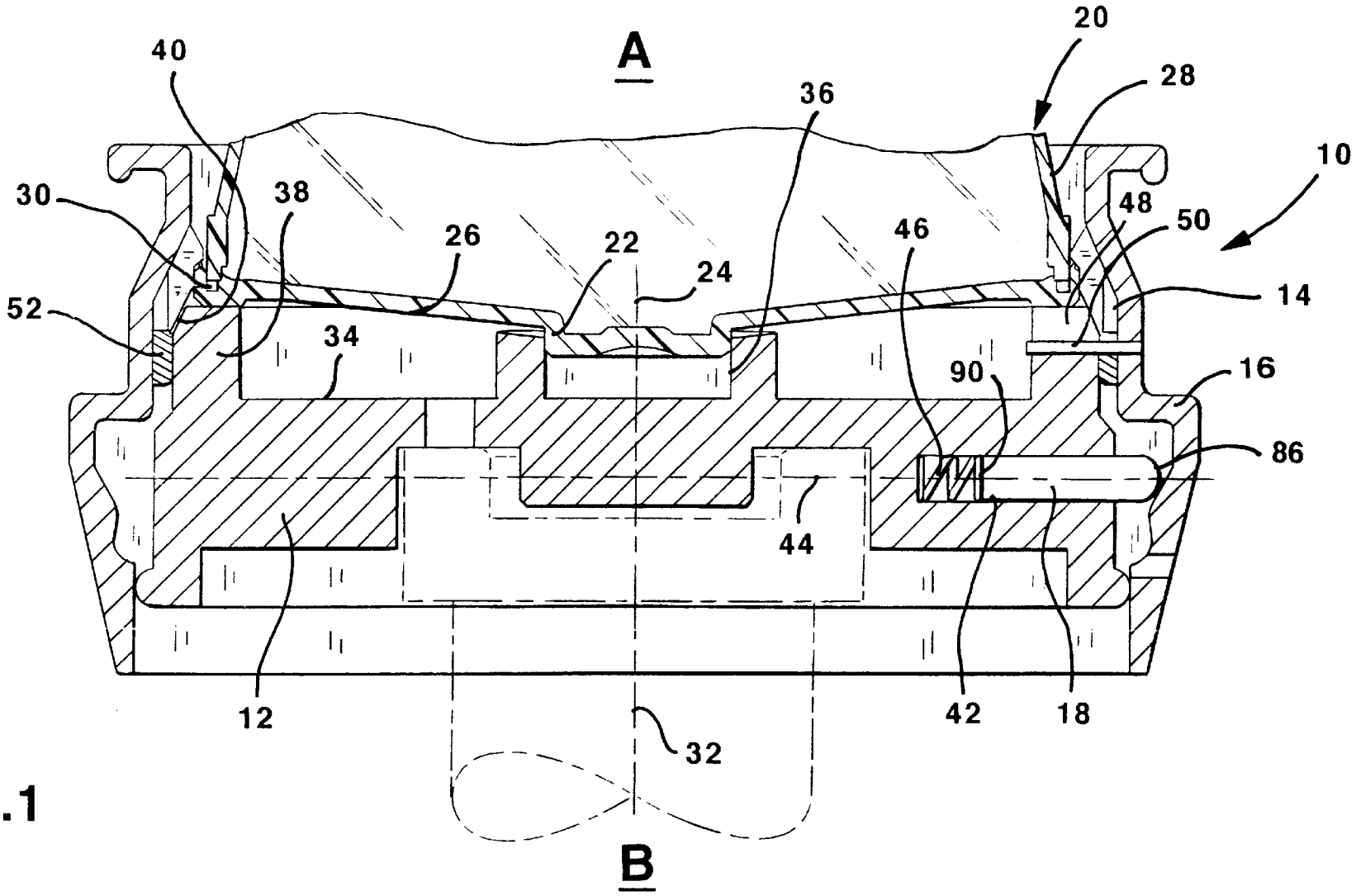
FIG. 1 is a side cross-sectional view of the present invention.

FIG. 1 shows the chuck for fixing a blood centrifuge bowl to a rotating spindle according to the present invention generally labeled 10. Chuck 10 has four basic components: base plate 12, finger ring 14, collar 16 and plungers 18.

Figure 11:
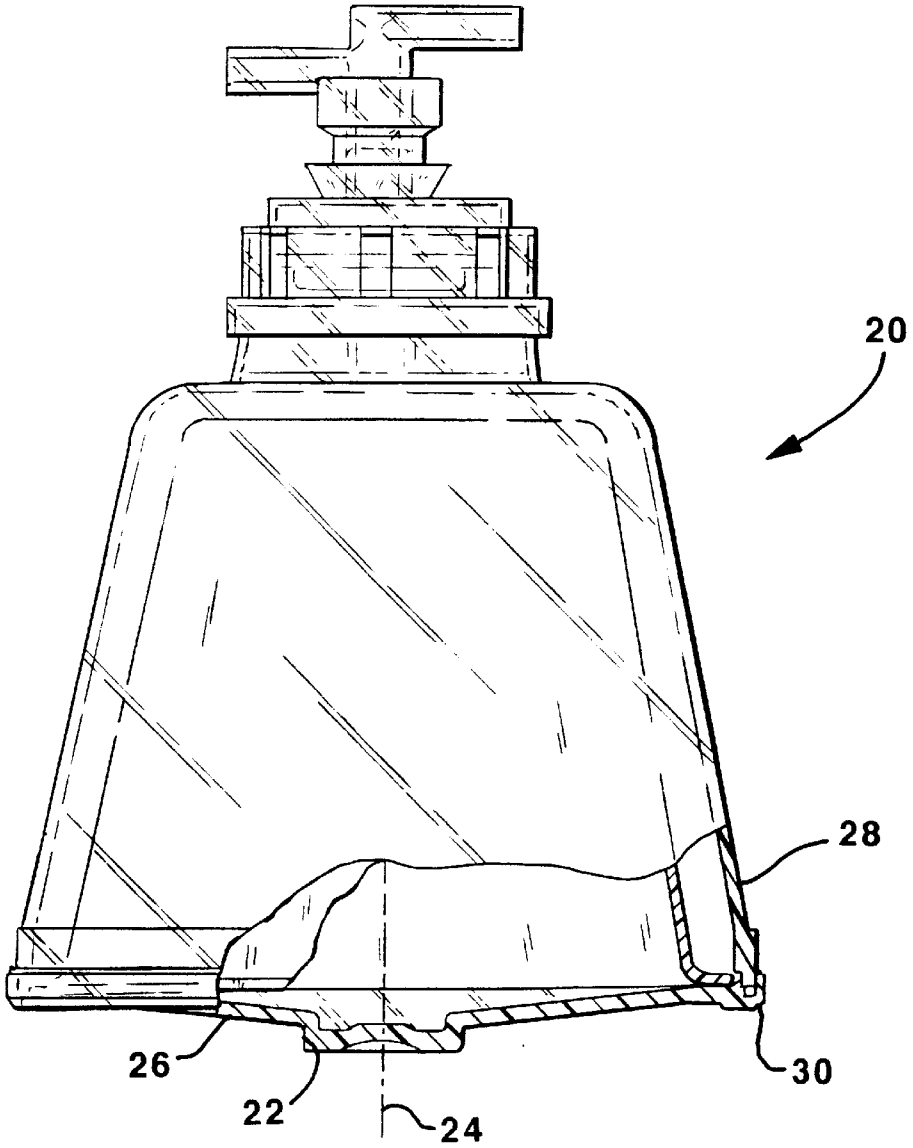
FIG. 11 is a perspective cutaway view of the blood bowl used in the invention.

The centrifugal blood bowl, generally labeled 20, contains the blood to be washed and separated into its components (FIG. 11). Blood bowl 20 is hollow and may be generally conical in shape. An example of blood bowl 20 is the blood bowl sold in the Sequestra 1000 system sold by Medtronic-Electromedics in Parker, Colo. Blood bowl 20 preferably has a pilot 22 located on the central axis 24 of blood bowl 20. Pilot 22 extends away from the lower base 26 of blood bowl 20. Blood bowl 20 has an outer surface 28 and an outer edge 30 that is the outer-most edge of blood bowl 20.

Figure 3:
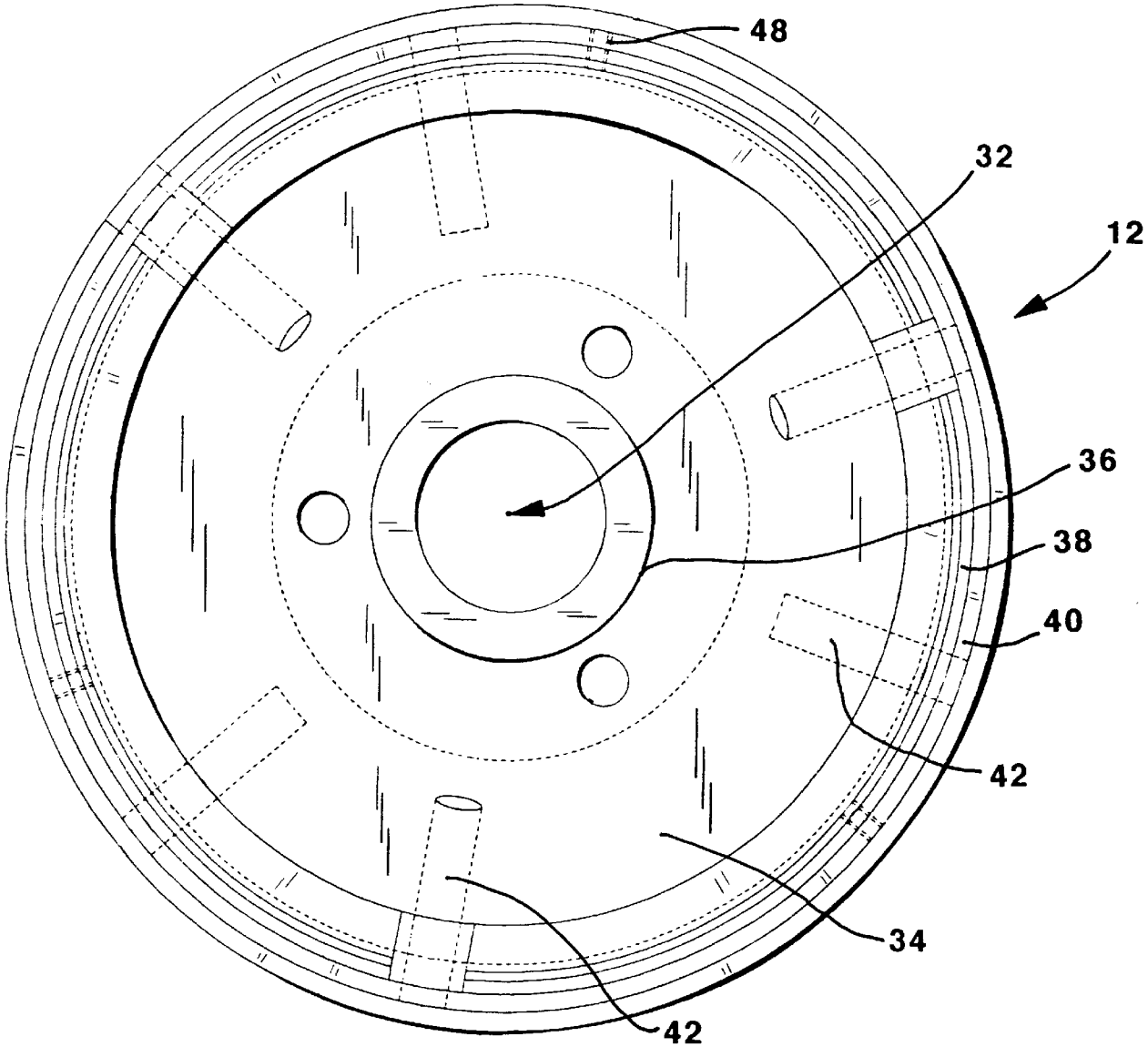
FIG. 3 is a top view of the base plate of the present invention.
Figure 4:
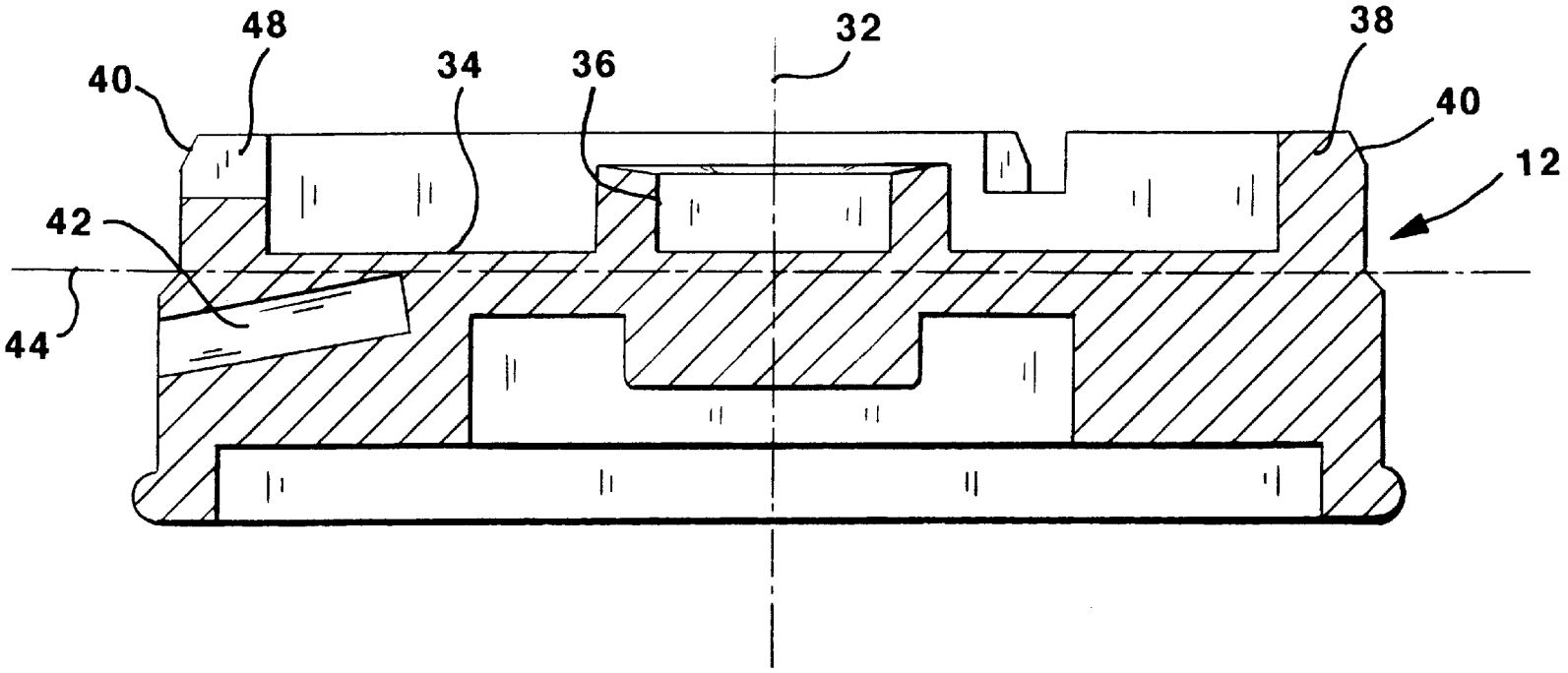
FIG. 4 is a side cross-sectional view of the base plate of FIG. 3.

Chuck 10 includes a generally disk shaped base plate 12 as shown in more detail in FIGS. 3 and 4. Base plate 12 has an upper surface 34 and preferably has a cylindrical pilot bore 36 that extends from upper surface 34 of base plate 12. Pilot bore 36 is concentric with central axis 32 of base plate 12. Pilot bore 36 has an inner diameter slightly larger than the outer diameter of pilot 22. In this way, pilot bore 36 may receive pilot 22 when the central axis 24 of blood bowl 20 is aligned with central axis 32 of base plate 12 and blood bowl 20 is moved towards base plate 12.

An annular ridge 38 extends upward from upper surface 34 around the outer periphery of base plate 12. The outer, upper corner of ridge 38 has a flat cam surface 40 formed at an angle to ridge 38.

Base plate 12 has a series of plunger bores 42 formed in base plate 12 that extend radially from central axis 32. Preferably there are at least three plunger bores 42 to provide a balanced base plate 12 during centrifugation. However, it is to be understood that there may be more or fewer than three plunger bores 42. In the most preferred embodiment, there are six plunger bores 42.

Figure 5A:
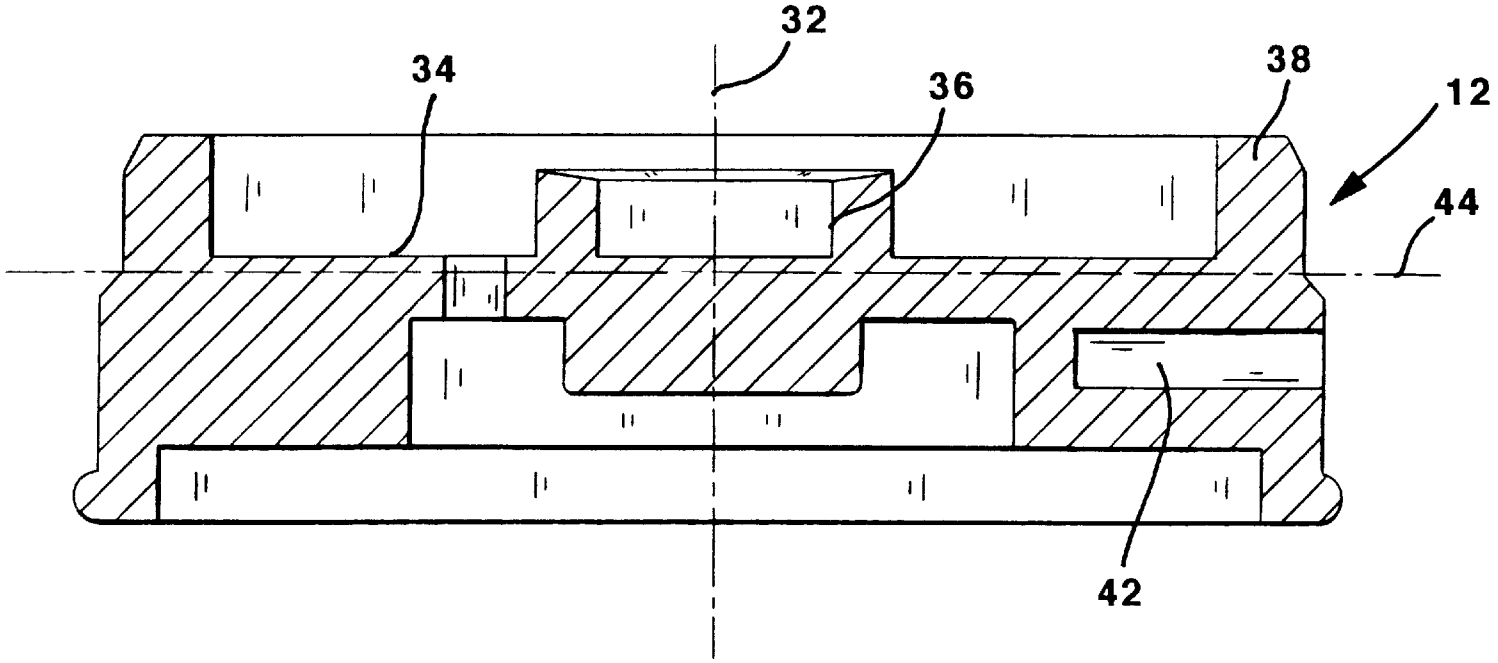
FIG. 5A is a another side cross-sectional view of the base plate of FIG. 3.

In the preferred embodiment shown in FIG. 4, plunger bores 42 extend within base plate 12 at an angle of about 10° downward from the transverse axis 44 to central axis 32. In an alternate embodiment shown in FIG. 5A, plunger bores 42 extend through base plate 12 essentially parallel to transverse axis 44. Although these specific embodiments for plunger bores 42 have been disclosed, plunger bores 42 at other angles, including angles upward from the transverse axis 44 are also within the scope of the invention. In addition, plunger bores 42 are not limited to being precisely aligned with radials from central axis 32.

Each plunger bore 42 preferable has a spring 46 located at the end of plunger bore 42 closest to central axis 32. Spring 46 biases plunger 18 within plunger bore 42 as will be described in detail hereafter.

Figure 5B:
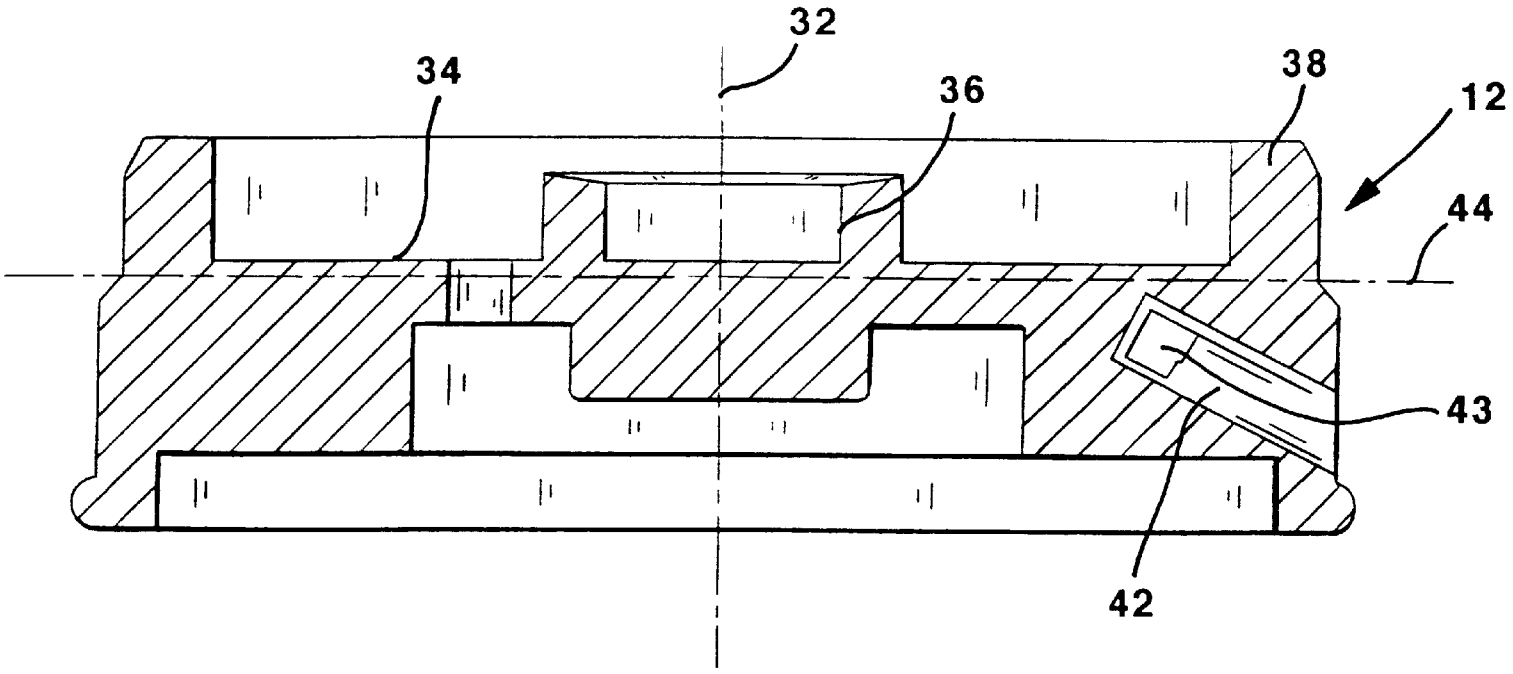
FIG. 5B is another side cross-sectional view of the base plate of FIG. 3.

In the preferred embodiment, spring 46 performs the biasing function on plunger 18. In this preferred embodiment, the axes of compression of springs 46 and the corresponding axes of plunger bores 42 are aligned. However, it is anticipated that those skilled in the art will recognize means other than springs 46 for biasing plunger 18. Referring to FIG. 5B, examples of these biasing means 43 include but are not limited to magnetic repulsion, pneumatic pressure, hydraulic pressure, or, particularly in the embodiment of plunger bores 42 angled downward from the transverse axis 44 to central axis 32, gravitational force.

Base plate 12 also preferably has a series of lock actuator pin receiving slots 48 formed in ridge 38. Lock actuator pin receiving slots 48 extend downwardly into ridge 38 to receive lock actuator pins 50 as will be described in detail hereafter. Lock actuator pin receiving slots 48 extend downward into ridge 38 a sufficient distance to allow lock actuator pin 50 to move downward sufficiently to allow blood bowl 20 to be securely positioned against base plate 12.

Base plate 12 may be made of general plastics or ferrous or non-ferrous alloys including, but not limited to acetal, phenolics, polymide-imides, ABS, aluminum, titanium or tool steels by machining or molding as will be appreciated by those skilled in the art. However, it is to be understood that base plate 12 may also be made of any rigid, durable material.

Figure 6:
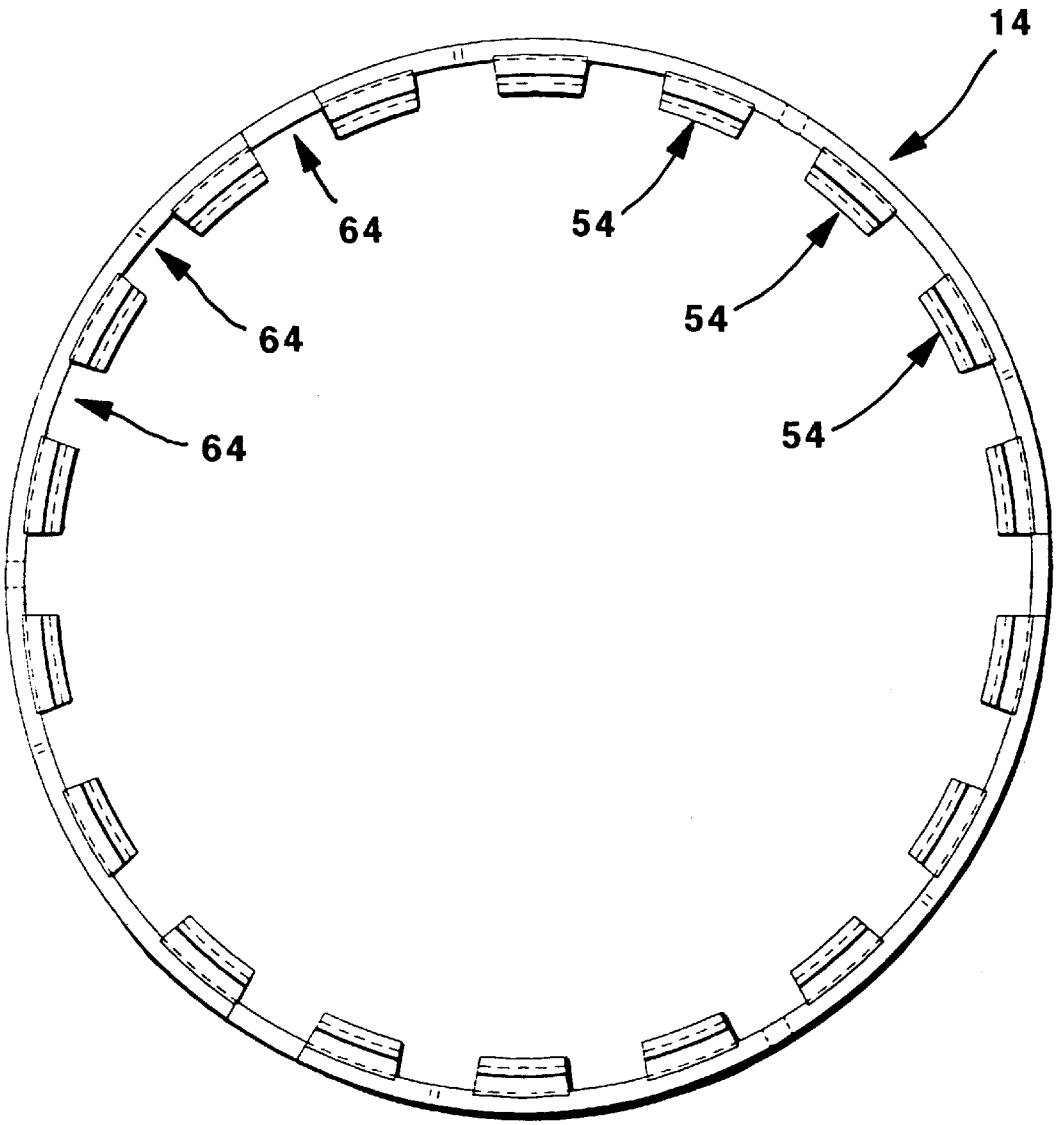
FIG. 6 is a top view of the lock ring of the present invention.
Figure 7:
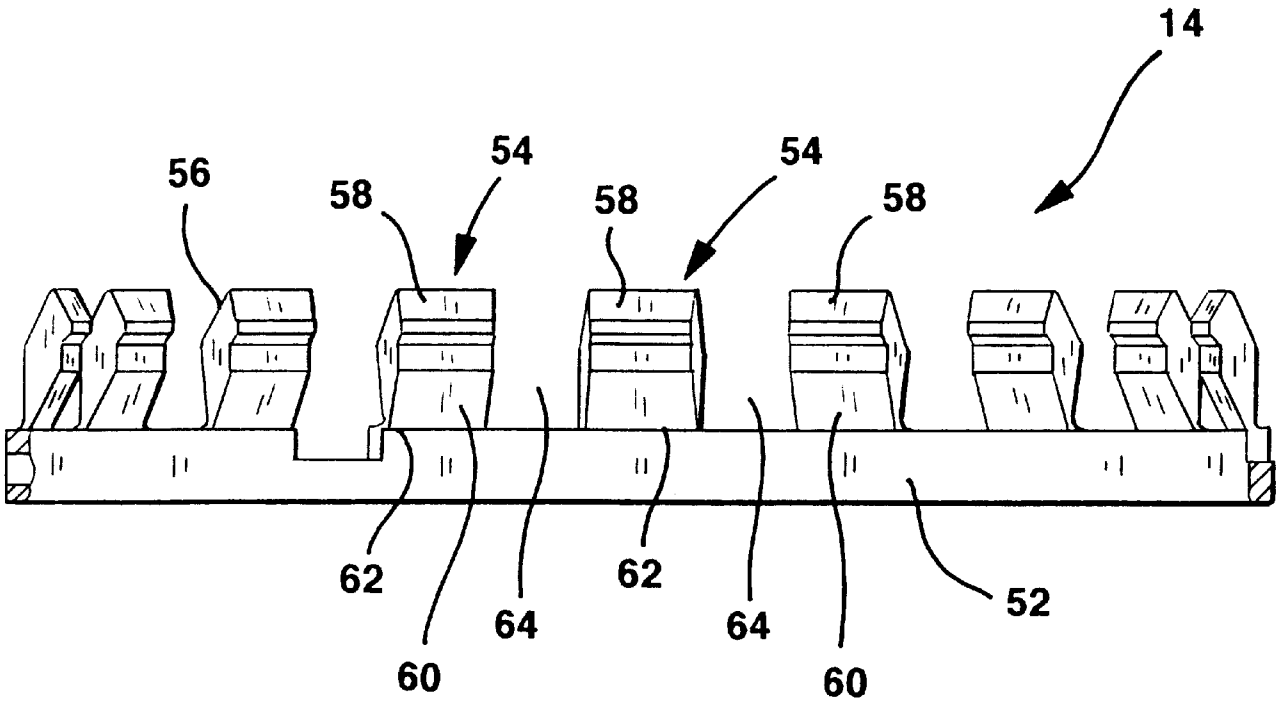
FIG. 7 is a side cross-sectional view of a portion of the lock ring of FIG. 6.
Figure 8:
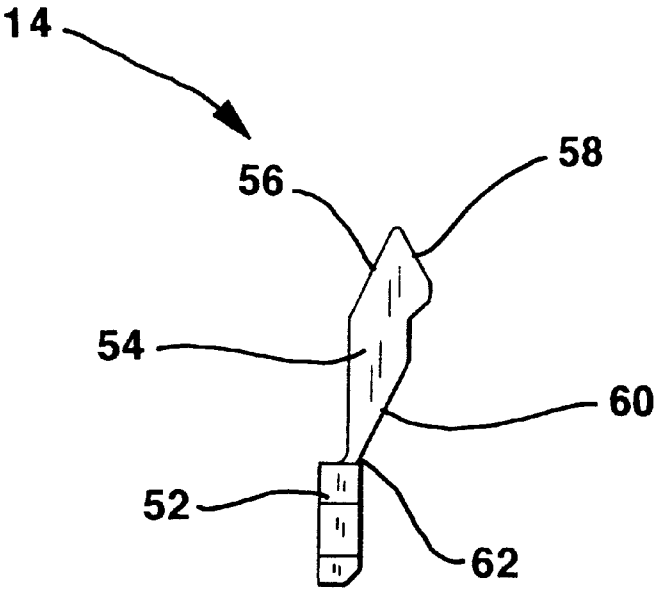
FIG. 8 is a close-up view of one of the "fingers" of the lock ring of FIG. 6.

Chuck 10 includes a finger ring 14 as shown in more detail in FIGS. 6–8. Finger ring 14 has an annular base 52 with a series of fingers 54 extending upward from base 52. Base 52 connects fingers 54 and provides a means for positioning fingers 54 by contacting ridge 38 as will be explained hereafter. In the preferred embodiment, there are 18 fingers 54 although there may be more or fewer fingers 54 as desired.

The cross-section view of finger ring 14 shown in FIG. 8 shows a single finger 54 in cross-section. Finger 54 has a collar contact surface 56, a bowl contact surface 58, a cam contact surface 60 and a living hinge 62. Living hinge 62 connects finger 54 to annular base 52 and allows finger 54 to pivot around living hinge 62 relative to base 52. Fingers 54 are offset inwardly from base 52 at living hinge 62. As is best shown in FIGS. 6 and 7, a space 64 separates each finger 54 from its neighboring finger 54 around annular base 52. This allows fingers 54 to flex inwardly around each finger 54's respective living hinge 62 without contacting and interfering with adjoining fingers 54.

Figure 2:
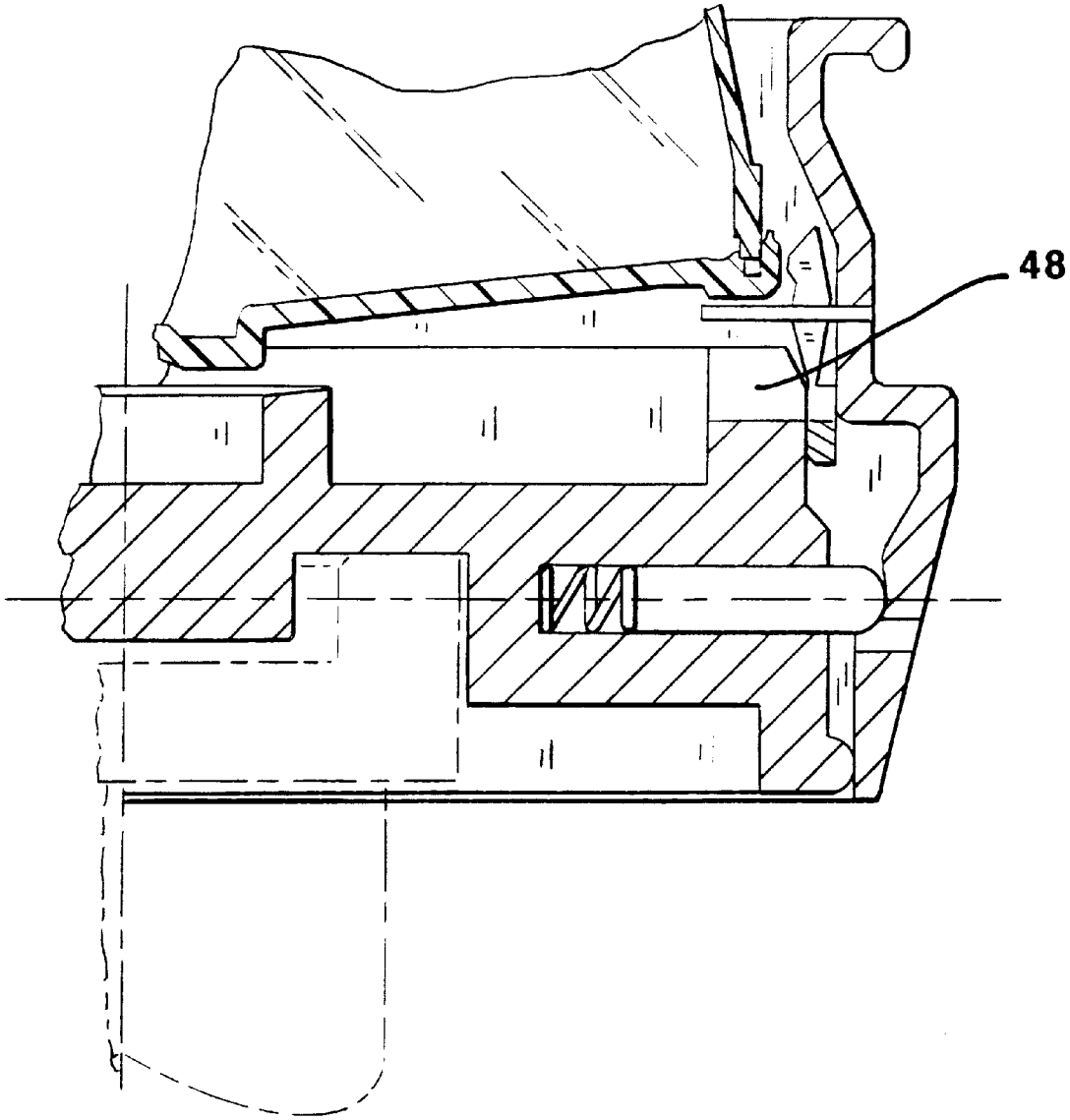
FIG. 2 is a side cross-sectional view of a portion of the invention of FIG. 1.

Finger ring 14 is placed around ridge 38 as shown in FIGS. 1 and 2 so living hinges 62 allow fingers 54 to pivot toward and away from central axis 32 over ridge 38. In this configuration, base 52 is positioned around the periphery of ridge 38. Fingers 54 are prevented from moving too far inward over ridge 38 by contact between cam contact surface 60 and cam surface 40.

Finger ring 14 is preferably made in one piece of a flexible polymeric material such as polyethylene, polypropylene, polyvinyl, acetyl or nylon. However, finger ring 14 may be made of any flexible, durable material. In addition, finger ring 14 may be made in several pieces and joined together as will be clear to those skilled in the art.

Figure 9:
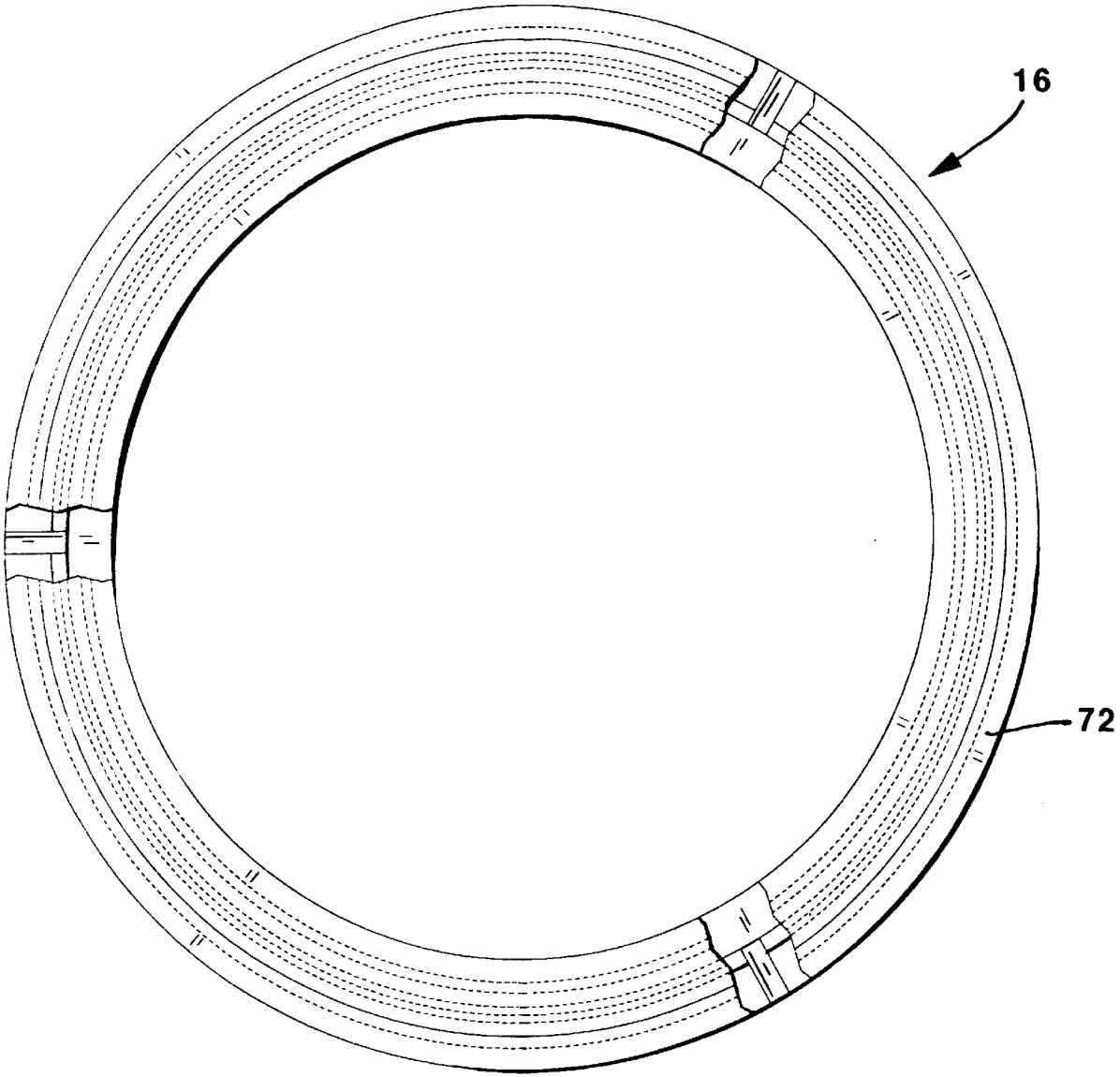
FIG. 9 is a top view of the collar of the invention.
Figure 10:
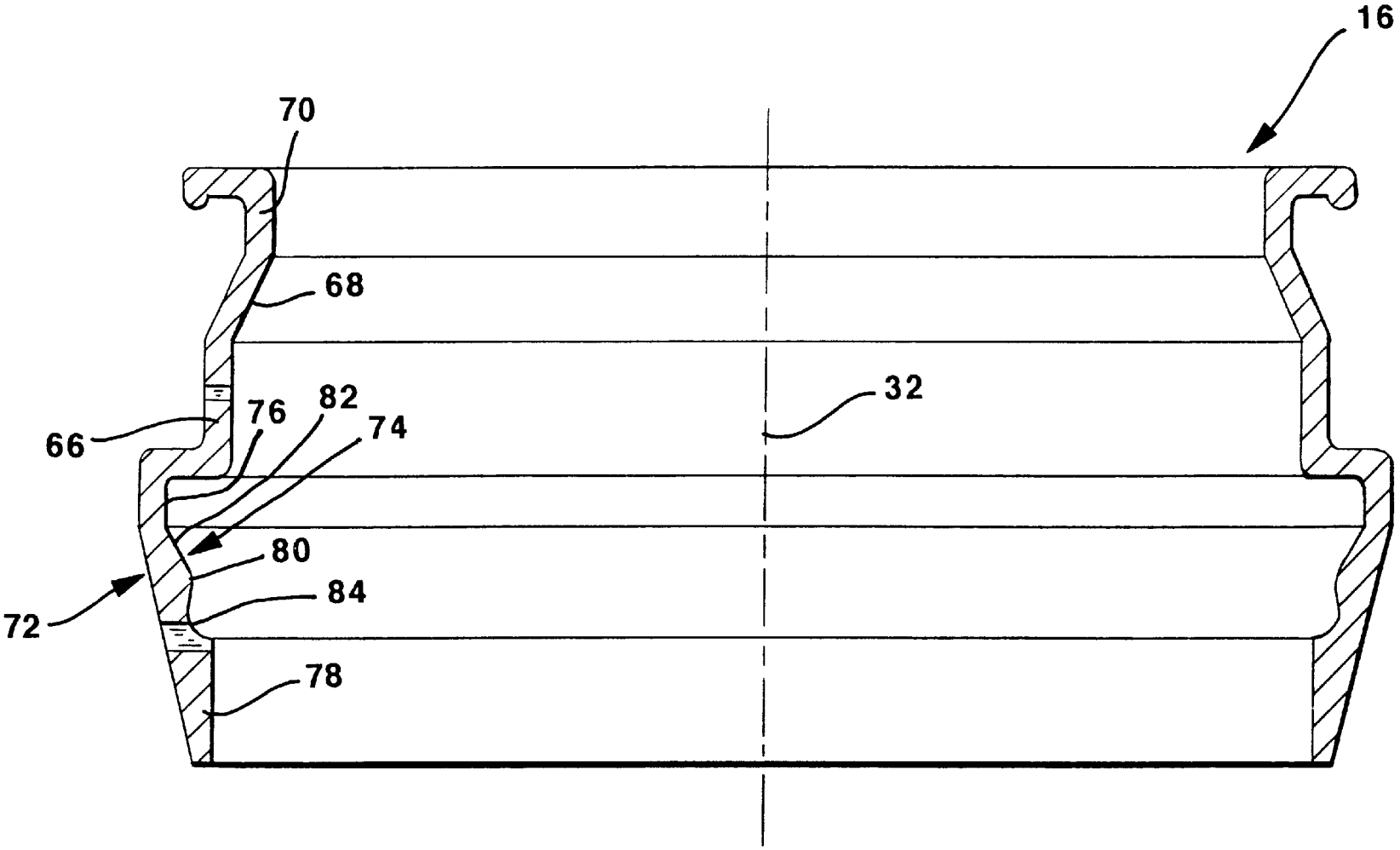
FIG. 10 is a side cross-sectional view of the collar of FIG. 9.

A collar 16 is provided as shown in FIGS. 9 and 10. Collar 16 has a generally cylindrical main body 66 contoured to fit concentrically around finger ring 14 when finger ring 14 is in position around ridge 38 as described above. An annular finger contact surface 68 extends upwardly and inwardly from main body 66. Finger contact surface 68 is shaped to contact collar contact surface 56. The upper end of finger contact surface 68 terminates in a generally upwardly directed upper collar surface 70.

A plunger capture wall 72 is formed attached to and beneath main body 66 of collar 16. Generally, plunger capture wall 72 is formed a greater radial distance from central axis 32 than main body 66 to form a plunger capture space 74 defined by plunger capture wall 72. Plunger capture wall 72 has a substantially vertical upper wall 76 at a first distance from the central axis 32. Plunger capture wall 72 also has a substantially vertical lower wall 78 at a second distance from central axis 32. The second distance is less than the first distance. A build-up of material at the upper end of lower wall 78 forms an inwardly directed plunger resistance ridge 80.

A sloping pressure wall 82 connects resistance ridge 80 to upper wall 76. Pressure wall 82 has an increasing inner diameter moving upward from resistance ridge 80 to upper wall 76. A plunger detent 84 connects resistance ridge 80 to lower wall 78. Plunger detent 84 is formed conformal to the outer end 86 of plunger 18. Plunger detent 84 conformally receives the outer end 86 of plunger 18 as will be explained hereafter.

In the preferred embodiment, a lock actuator pin 50 extends inwardly from the main body 66 of collar 16. Lock actuator pin 50 has a length that allows lock actuator pin 50 to extend into and interact with lock actuator pin receiving slots 48 in base plate 12 when chuck 10 is assembled as will be explained hereafter.

Collar 16 is preferably made of ferrous or non-ferrous alloys including, but not limited to, aluminum, titanium or tools steels by machining or other manufacturing means known to those skilled in the art. However, it is to be understood that collar 16 may also be made of any rigid, durable material.

Collar 16 has been described as being generally cylindrical. This means that collar 16 has a generally tube shape with an inside and an outside surface. Collar 16 may also have a shape other than cylindrical including, but not limited to, conical so long as collar 16 has an inner surface and an outer surface as described herein. The inner surface of collar 16, in whatever shape collar 16 may be, should be configured to have a finger contact surface 68 or sloping pressure wall 82 or both.

A plunger 18 is placed in each of the plunger bores 42. Plunger 18 preferably has a cylindrical shape of slightly less outer diameter than the inner diameter of plunger bores 42. Plunger 18 has an inner end 90 and an outer end 86. Plungers 18 are also preferably made of a material having a relatively high density such as bronze, brass, copper, titanium tool steel, iron or babbit alloys, to name but a few possible choices.

When in place within plunger bores 42, the inner end 90 of plunger 18 contacts spring 46. Spring 46 biases the outer end 86 of plunger 18 outwardly from central axis 32. Plunger 18 has a length that allows outer end 86 to extend a small distance out of plunger bore 42 when plunger 18 is in plunger bore 42 and inner end 90 is in contact with spring 46.

FIGS. 1 and 2 show the fully assembled chuck 10 in a locked and unlocked configuration, respectively. As can be seen, plungers 18 are placed in plunger bores 42 so that the inner ends 90 contact springs 46 and outer ends 86 extend a small distance out of plunger bores 42. Finger ring 14 is placed around base plate 12 so that base 52 encircles ridge 38. Base 52 is positioned along ridge 38 so that living hinge 62 allows cam contact surface 60 to pivot into and out of contact with cam surface 40. Collar 16 is placed concentrically around both base plate 12 and finger ring 14 so that plungers 18 extend into plunger capture space 74.

In the unlocked position shown in FIG. 2, collar 16 is moved upward so that plunger detent 84 receives the outer end 86 of plunger 18. In this position, plunger 18 slightly compresses spring 46 biasing the outer end 86 of plunger 18 into firm contact with plunger detent 84. This firm pressure holds collar 16 is a raised position. In this raised position, finger contact surface 68 is raised upward from collar contact surface 56. As a result, finger contact surface 68 does not contact collar contact surface 56. This removes any inward pressure or bias against finger 54 and allows finger 54 to relax around living hinge 62.

In this relaxed position, a blood bowl 20 can be moved downward into the chuck 10. Blood bowl 20 moves downwardly until pilot 22 locates itself in pilot bore 36. This is accomplished by aligning central axes 24 and 36 and moving blood bowl 20 downward into contact with base plate 12. As a result, blood bowl 20 contacts base plate 12 with central axis 24 and central axis 32 aligned and with pilot 22 engaged with pilot bore 36. As blood bowl 20 moves downwardly, the outer edge 30 of blood bowl 20 contacts lock actuator pin 50. The contact of the outer edge 30 with lock actuator pin 50 moves the entire collar 16 downward with the downward movement of blood bowl 20.

As blood bowl 20 and collar 16 move downward, finger contact surface 68 moves into contact with collar contact surface 56. Finger contact surface 68 has a decreasing inner diameter moving upward along finger contact surface 68. As a result, downward movement of finger contact surface 68 causes inward and downward pressure on collar contact surface 56. This inward and downward pressure on collar contact surface 56 causes finger 54 to pivot around living hinge 62. This inward and downward motion of finger 54 around living hinge 62 causes bowl contact surface 58 to move into contact with the outer surface 28 of blood bowl 20.

The more collar 16 moves downward, the more finger contact surface 68 moves fingers 54 inward and downward and in more secure contact with the outer surface 28 of blood bowl 20. This inward and downward pressure on blood bowl 20 causes blood bowl 20 to be securely seated against the pilot bore 36 and ridge 38 of base plate 12. Contact between cam contacting surface 60 and cam surface 40 prevents fingers 54 from moving too far inwardly or downwardly thereby exerting excessive pressure on outer surface 28 of blood bowl 20.

Downward movement of collar 16 causes the outer end 86 of plungers 18 to move over resistance ridge 80 into contact with the sloped pressure wall 82 of upper wall 76. When pilot 22 is securely located in pilot bore 36, the outer end 86 of plunger 18 contacts pressure wall 82 under the bias of spring 46 as shown in FIG. 1.

In operation, chuck 10 is connected to a source of rotation so that chuck 10 rotates around central axis 32 at high speed, typically around about 5600 RPM. Operating at this rotational speed and with a typical outer diameter of chuck 10 of about six inches produces centrifugal forces on the outer surface of the chuck 10 in excess of 1400 times the force of gravity. This centrifugal force applies as well to plungers 18 within plunger bores 42. The centrifugal force applies an outwardly directed force on plungers 18 within bores 42. This outward force on plungers 18 causes outer ends 86 to be biased against sloping pressure wall 82. As plungers 18 receive more centrifugal force, more outward force is applied against sloping pressure wall 82 by contact with outer end 86.

Sloping pressure wall 82 slopes outwardly moving in an upward direction. As a result, increased outwardly directed pressure on outer end 86 against sloping pressure wall 82 causes sloping pressure wall 82 to be biased to move downwardly. As sloping pressure wall 82 tries to move downwardly, the entire collar 16 tries to move downwardly. As collar 16 tries to move downwardly, finger contact surface 68 tries to move downwardly. This downward pressure on finger contact surface 68 increases the pressure exerted against collar contact surface 56. The increased pressure against collar contact surface 56 creates greater inward and downward pressure by bowl contact surface 58 against the outer surface 28 of blood bowl 20. This increased inward and downward pressure by blood bowl contact surface 58 on the outer surface 28 of blood bowl 20 holds bowl 20 firmly in position within chuck 10.

To remove blood bowl 20 from chuck 10, collar 16 is pulled upward. This causes plungers 18 to move over resistance ridge 80 into plunger detent 84. Simultaneously, finger contact surface 68 moves away from collar contact surface 56 allowing fingers 54 to relax around living hinge 62. This moves bowl contact surface 58 away from the outer surface 28 of blood bowl 20. Thereafter, blood bowl 20 is moved upward away from contact with base plate 12 and out of chuck 10.

In the invention, downward pressure applied by collar 16, either by manual pressure or by the action of plungers 18, is transferred through fingers 54 into inward and downward pressure on the outer surface 28 of blood bowl 20. In the preferred embodiment, downward manual movement of blood bowl 20 is transferred to collar 16 to cause downward movement and pressure on collar 16 through lock actuator pins 50.

Although it is preferred to use lock actuator pins 50, an alternate embodiment of the invention does not include lock actuator pins 50. In this embodiment, blood bowl 20 is moved into contact with base plate 12 so that pilot 22 locates itself in pilot bore 36. Because there is no lock actuator pin 50, downward movement of blood bowl 20 does not cause downward movement of collar 16. Instead, once pilot 22 is secured in pilot bore 36, manual downward pressure is applied to the upper collar surface 70. This moves collar 16 down so that finger contact surface 68 moves into contact with collar contact surface 56 and the outer end 86 of plunger 18 moves over resistance ridge 62 into contact with the sloped pressure wall 82 of upper wall 76.

The preferred embodiment of the invention includes the combination a first part that converts downward movement of an outer collar of a chuck into inward and downward pressure against a blood bowl to be secured in the chuck and a second part that converts centrifugal forces present in a rotating chuck into downward pressure on the collar. The first part includes chuck 10 having collar 16 with finger contact surface 68, fingers 54 with collar contact surface 56 and base plate 12. The second part includes chuck 10 having base plate 12 with plunger bores 42, collar 16 with sloping pressure wall 82 and plungers 18. However, the first and second part may operate independently and exclusively of each other.

Throughout this description, reference has been made to a preferred embodiment of centrifugal blood bowl 20. Blood bowl 20 has been described as having a pilot 22 located on the central axis 24 of blood bowl 20 that 22 extends away from the lower base 26 of blood bowl 20. Blood bowl 20 moves downwardly until pilot 22 locates itself in pilot bore 36. Although the preferred embodiment contemplates using a base plate 12 with a pilot bore 36, the invention in its broadest form does not require a blood bowl 20 with a pilot 22 or a base plate 12 with a pilot bore 36. Instead, the invention requires that blood bowl 20 be securely in contact with base plate 12 in any configuration that will be clear to those skilled in the art.

The invention has been described in connection with a specific embodiment. As described above, the specific embodiment includes a collar 16 having both a finger contact surface 68 and a sloping pressure wall 82. However, as described above, it is also within the scope of the invention to have a collar 16 having either a finger contact surface 68 or a sloping pressure wall 82, but not both. Further, it is to be understood that the description given herein is for the purpose of illustration only and is not intended to be limiting. Other changes and modifications will occur to those skilled in the art.

What is claimed is:

1. A chuck for fixing a blood centrifuge bowl to a rotating spindle, the chuck having a central axis, the chuck comprising:

a) a base having an outer periphery, the base having at least one finger extending upward from the outer periphery of the base, the finger having a collar contact surface and a bowl contact surface and wherein the finger is made of a material with sufficient flexibility to allow the finger to move toward and away from the central axis of the chuck;

b) a collar having a main body, the collar having an upper side and a lower side, the main body being contoured to fit around the base and finger, the main body including a finger contact surface that slopes inwardly from the main body moving from the lower side to the upper side, the finger contact surface shaped to contact the collar contact surface;

whereby, downward movement of the collar causes the finger contact surface to contact the collar contact surface and move the finger toward the central axis of the chuck.

2. The chuck of claim 1 wherein the finger has a cam contact surface and the base has an upwardly directed cam surface whereby the at least one finger is prevented from moving too far toward the central axis of the chuck by contact between the cam contact surface and the cam surface.

3. The chuck of claim 2 wherein the base also has at least one lock actuator pin receiving slot formed downwardly in the cam surface and further comprising a lock actuator pin that extends inwardly from the main body of the collar whereby, the lock actuator pin is received in the lock actuator pin receiving slot.

4. The chuck of claim 1 wherein the base further comprises an annular finger ring around which the collar fits, and wherein the at least one finger is attached to and extends away from the finger ring by a flexible connection.

5. The chuck of claim 4 wherein the flexible connection is a living hinge.

6. The chuck of claim 1 wherein the base has at least at least one plunger bore formed in the base extending radially from the central axis of the chuck, the base having a transverse plane formed therein perpendicular to the central axis of the chuck.

7. The chuck of claim 6 wherein the at least one plunger bore extends within the base at an angle downward from the transverse plane.

8. The chuck of claim 6 wherein the at least one plunger bore extends within the base essentially parallel to the transverse plane.

9. The chuck of claim 6 wherein the at least one plunger bore extends within the base at an angle upward from the transverse plane.

10. The chuck of claim 6 further comprising a plunger wherein the at least one plunger bore has means for biasing the plunger away from the central axis.

11. The chuck of claim 10 wherein the means for biasing is a spring.

12. The chuck of claim 10 wherein the means for biasing is chosen from the group consisting of magnetic repulsion, pneumatic pressure, hydraulic pressure or gravitational force.

13. A chuck for fixing a blood centrifuge bowl to a rotating spindle, the chuck having a central axis, the chuck comprising:

a) a base plate having a transverse plane within the base plate that intersects the central axis at a right angle, the base plate having an upper surface, an outer periphery and a cam surface that extends upward from the upper surface of the base plate around the outer periphery of the base plate;

b) at least one finger extending upward from the outer periphery of the base plate, the finger having a collar contact surface, a bowl contact surface and a cam contact surface and wherein the finger is made of a material with sufficient flexibility to allow the finger to move toward and away from the central axis;

c) a collar having a main body, the collar having an upper side and a lower side, the main body being contoured to fit around the base plate, the main body including a finger contact surface that slopes inwardly from the main body moving from the lower side to the upper side, the finger contact surface shaped to contact the collar contact surface;

whereby, downward movement of the collar causes the finger contact surface to contact the collar contact surface and move the finger toward the central axis of the chuck, and, whereby, contact between the cam surface and the cam contact surface prevents the finger from moving too far toward the central axis of the chuck.

14. The chuck of claim 13 wherein the base plate has a cylindrical pilot bore that extends from the upper surface of the base plate.

15. The chuck of claim 14 wherein the pilot bore is concentric with the central axis of the base plate.

16. The chuck of claim 13 wherein the base plate further comprises an annular finger ring around which the collar fits, and wherein the at least one finger is attached to and extends away from the finger ring by a flexible connection.

17. The chuck of claim 16 wherein the flexible connection is a living hinge.

18. The chuck of claim 13 wherein the base plate also has at least one lock actuator pin receiving slot formed downwardly in the cam surface and further comprising a lock actuator pin that extends inwardly from the main body of the collar whereby, the lock actuator pin is received in the lock actuator pin receiving slot.

19. The chuck of claim 13 wherein the base plate has at least at least one plunger bore formed in the base plate extending radially from the central axis of the chuck.

20. The chuck of claim 19 wherein the at least one plunger bore extends within the base plate at an angle downward from the transverse plane.

21. The chuck of claim 19 wherein the at least one plunger bore extends within the base plate essentially parallel to the transverse plane.

22. The chuck of claim 19 wherein the at least one plunger bore extends within the base plate at an angle upward from the transverse plane.

23. The chuck of claim 19 further comprising a plunger wherein the at least one plunger bore has means for biasing the plunger away from the central axis.

24. The chuck of claim 23 wherein the means for biasing is a spring.

25. The chuck of claim 23 wherein the means for biasing is chosen from the group consisting of magnetic repulsion, pneumatic pressure, hydraulic pressure or gravitational force.

26. A chuck for fixing a blood centrifuge bowl to a rotating spindle, the chuck having a central axis, the chuck comprising:

a) a base plate having a transverse plane within the base plate that intersects the central axis at a right angle, the base plate having an upper surface, an outer periphery and at least one plunger bore formed in the base plate extending away from the central axis;

b) at least one finger extending upward from the outer periphery of the base plate, the finger having a collar contact surface and a bowl contact surface and wherein the finger is made of a material with sufficient flexibility to allow the finger to move toward and away from the central axis;

c) a collar having an upper side and a lower side, the collar having a main body, the main body being contoured to fit around the base plate and finger, the main body including:

1) a finger contact surface that slopes toward the central axis from the main body moving from the lower side to the upper side, the finger contact surface shaped to contact the collar contact surface;

2) a plunger capture wall formed at the lower edge of the main body, the plunger capture wall having a sloping pressure wall that slopes toward the central axis moving from the upper side to the lower side;

d) at least one plunger located in the respective plunger bore and able to move along the plunger bore;

whereby, movement of the chuck around the central axis produces centrifugal forces that cause the plunger to move away from the central axis in the plunger bore, and whereby, contact between the plunger and the plunger pressure wall causes downward movement of the collar, and, whereby, downward movement of the collar causes the finger contact surface to contact the collar contact surface and move the finger toward the central axis of the chuck.

27. The chuck claim 26 wherein the base plate has a cam surface that extends upward from the upper surface of the base plate around the outer periphery of the base plate and wherein the finger has a cam contact surface whereby contact between the cam surface and the cam contact surface prevents the finger from moving too far toward the central axis of the chuck.

28. The chuck of claim 27 wherein the cam surface is an annular ridge that extends upward from the upper surface of the base plate around the outer periphery of the base plate, the annular ridge having an outer, upper corner, the outer, upper corner having the cam surface.

29. The chuck of claim 28 wherein the base plate also has at least one lock actuator pin receiving slot formed downwardly in the cam surface and further comprising a lock actuator pin that extends inwardly from the main body of the collar whereby the lock actuator pin receiving slot receives the lock actuator pin.

30. The chuck of claim 26 wherein the base plate has a cylindrical pilot bore that extends from the upper surface of the base plate.

31. The chuck of claim 30 wherein the pilot bore is concentric with the central axis of the base plate.

32. The chuck of claim 26 wherein the base plate further comprises an annular finger ring around which the collar fits, and wherein the at least one finger is attached to and extends away from the finger ring by a flexible connection.

33. The chuck of claim 32 wherein the flexible connection is a living hinge.

34. The chuck of claim 26 wherein the at least one plunger bore is formed in the base plate extending radially from the central axis of the chuck.

35. The chuck of claim 26 wherein the at least one plunger bore extends within the base plate at an angle downward from the transverse plane.

36. The chuck of claim 26 wherein the at least one plunger bore extends within the base plate essentially parallel to the transverse plane.

37. The chuck of claim 26 wherein the at least one plunger bore extends within the base plate at an angle upward from the transverse plane.

38. The chuck of claim 26 further comprising a plunger wherein the at least one plunger bore has means for biasing the plunger away from the central axis.

39. The chuck of claim 38 wherein the means for biasing is a spring.

40. The chuck of claim 38 wherein the means for biasing is chosen from the group consisting of magnetic repulsion, pneumatic pressure, hydraulic pressure or gravitational force.

41. The chuck of claim 26 wherein the plunger capture wall includes a plunger detent located below the pressure wall and a resistance ridge formed between the pressure wall and the plunger detent.

42. A system for centrifuging blood comprising:

a) a blood bowl having a central axis, an outer surface, an outer edge and a lower base; and, b) a chuck comprising:

1) a base having an outer periphery, the base having at least one finger extending upward from the outer periphery of the base, the finger having a collar contact surface and a bowl contact surface and wherein the finger is made of a material with sufficient flexibility to allow the finger to move toward and away from the central axis of the chuck;

2) a collar having a main body, the collar having an upper side and a lower side, the main body being contoured to fit around the base and finger, the main body including a finger contact surface that slopes inwardly from the main body moving from the lower side to the upper side, the finger contact surface shaped to contact the collar contact surface;

whereby, downward movement of the collar causes the finger contact surface to contact the collar contact surface and move the finger toward the central axis of the chuck; and, whereby movement of the finger toward the central axis of the chuck causes the bowl contact surface to contact the outer surface of the blood bowl.

43. The system of claim 42 wherein the finger has a cam contact surface and the base has an upwardly directed cam surface whereby the at least one finger is prevented from moving too far toward the central axis of the chuck by contact between the cam contact surface and the cam.

44. The system of claim 43 wherein the base also has at least one lock actuator pin receiving slot formed downwardly in the cam surface and further comprising a lock actuator pin that extends inwardly from the main body of the collar whereby, the lock actuator pin is received in the lock actuator pin receiving slot.

45. The system of claim 42 wherein the base further comprises an annular finger ring around which the collar fits, and wherein the at least one finger is attached to and extends away from the finger ring by a flexible connection.

46. The system of claim 45 wherein the flexible connection is a living hinge.

47. The system of claim 42 wherein the blood bowl has a pilot located on a central axis of the blood bowl that extends away from the lower base of the blood bowl.

48. The system of claim 42 wherein the base has a cylindrical pilot bore that extends from the upper surface of the base and wherein the pilot bore has an inner diameter slightly larger than the outer diameter of a pilot.

49. The system of claim 42 wherein the base has at least at least one plunger bore formed in the base extending radially from the central axis of the chuck, the base having a transverse plane formed therein perpendicular to the central axis of the chuck.

50. The system of claim 49 wherein the at least one plunger bore extends within the base at an angle downward from the transverse plane.

51. The system of claim 49 wherein the at least one plunger bore extends within the base essentially parallel to the transverse plane.

52. The system of claim 49 wherein the at least one plunger bore extends within the base at an angle upward from the transverse plane.

53. The system of claim 49 further comprising a plunger wherein the at least one plunger bore has means for biasing the plunger away from the central axis.

54. The system of claim 53 wherein the means for biasing is a spring.

55. The system of claim 54 wherein the means for biasing is chosen from the group consisting of magnetic repletion repulsion, pneumatic pressure, hydraulic pressure or gravitational force.

56. A system for centrifuging blood comprising:

a) a blood bowl having a central axis, an outer surface, an outer edge and a lower base; and, b) a chuck for fixing a blood bowl to a rotating spindle, the chuck having a central axis, the chuck comprising:

1) a base plate having a transverse plane within the base plate that intersects the central axis at a right angle, the base plate having an upper surface, an outer periphery and a cam surface that extends upward from the upper surface of the base plate around the outer periphery of the base plate;

2) at least one finger extending upward from the outer periphery of the base plate, the finger having a collar contact surface, a bowl contact surface and a cam contact surface and wherein the finger is made of a material with sufficient flexibility to allow the finger to move toward and away from the central axis;

3) a collar having a main body, the collar having an upper side and a lower side, the main body being contoured to fit around the base plate and finger, the main body including a finger contact surface that slopes inwardly from the main body moving from the lower side to the upper side, the finger contact surface shaped to contact the collar contact surface;

whereby, downward movement of the collar causes the finger contact surface to contact the collar contact surface and move the finger toward the central axis of the chuck and, whereby movement of the finger toward the central axis of the chuck causes the bowl contact surface to contact the outer surface of the blood bowl; and, whereby, contact between the cam surface and the cam contact surface prevents the finger from moving too far toward the central axis of the chuck.

57. The system of claim 56 wherein the base plate has a cylindrical pilot bore that extends from the upper surface of the base plate.

58. The system of claim 57 wherein the pilot bore is concentric with the central axis of the base plate.

59. The system of claim 56 wherein the base plate further comprises an annular finger ring around which the collar fits, and wherein the at least one finger is attached to and extends away from the finger ring by a flexible connection.

60. The system of claim 59 wherein the flexible connection is a living hinge.

61. The system of claim 56 wherein the blood bowl has a pilot located on a central axis of the blood bowl that extends away from the lower base of the blood bowl.

62. The system of claim 61 wherein the base plate has a cylindrical pilot bore that extends from the upper surface of the base plate and wherein the pilot bore has an inner diameter slightly larger than the outer diameter of the pilot.

63. The system of claim 56 wherein the base plate also has at least one lock actuator pin receiving slot formed downwardly in the cam surface and further comprising a lock actuator pin that extends inwardly from the main body of the collar whereby, the lock actuator pin is received in the lock actuator pin receiving slot.

64. The system of claim 56 wherein the base plate has at least at least one plunger bore formed in the base plate extending radially from the central axis of the chuck.

65. The system of claim 64 wherein the at least one plunger bore extends within the base plate at an angle downward from the transverse plane.

66. The system of claim 64 wherein the at least one plunger bore extends within the base plate essentially parallel to the transverse plane.

67. The system of claim 64 wherein the at least one plunger bore extends within the base plate at an angle upward from the transverse plane.

68. The system of claim 64 further comprising a plunger wherein the at least one plunger bore has means for biasing the plunger away from the central axis.

69. The system of claim 68 wherein the means for biasing is a spring.

70. The system of claim 68 wherein the means for biasing is chosen from the group consisting of magnetic repulsion, pneumatic pressure, hydraulic pressure or gravitational force.

71. A system for centrifuging blood comprising:

a) a blood bowl having a central axis, an outer surface, an outer edge and a lower base; and, b) a chuck for fixing a blood bowl to a rotating spindle, the chuck having a central axis, the chuck comprising:

1) a base plate having a transverse plane within the base plate that intersects the central axis at a right angle, the base plate having an upper surface, an outer periphery and at least one plunger bore formed in the base plate extending away from the central axis;

2) at least one finger extending upward from the outer periphery of the base plate, the finger having a collar contact surface and a bowl contact surface and wherein the finger is made of a material with sufficient flexibility to allow the finger to move toward and away from the central axis;

3) a collar having an upper side and a lower side, the collar having a main body, the main body being contoured to fit around the base plate and finger, the main body including:

a) a finger contact surface that slopes toward the central axis from the main body moving from the lower side to the upper side, the finger contact surface shaped to contact the collar contact surface;

b) a plunger capture wall formed at the lower edge of the main body, the plunger capture wall having a sloping pressure wall that slopes toward the central axis moving from the upper side to the lower side;

4) at least one plunger located in the respective plunger bore and able to move along the plunger bore;

whereby, movement of the chuck around the central axis produces centrifugal forces that cause the plunger to move away from the central axis in the plunger bore, and whereby, contact between the plunger and the plunger pressure wall causes downward movement of the collar, and, whereby, downward movement of the collar causes the finger contact surface to contact the collar contact surface and move the finger toward the central axis of the chuck and thereby contact and firmly hold the blood bowl.

72. The system of claim 71 wherein the base plate has a cam surface that extends upward from the upper surface of the base plate around the outer periphery of the base plate and wherein the finger has a cam contact surface whereby contact between the cam surface and the cam contact surface prevents the finger from moving too far toward the central axis of the chuck.

73. The system of claim 72 wherein the cam surface is an annular ridge that extends upward from the upper surface of the base plate around the outer periphery of the base plate, the annular ridge having an outer, upper corner, the outer, upper corner having the cam surface.

74. The system of claim 73 wherein the base plate also has at least one lock actuator pin receiving slot formed downwardly in the cam surface and further comprising a lock actuator pin that extends inwardly from the main body of the collar whereby the lock actuator pin receiving slot receives the lock actuator pin.

75. The system of claim 71 wherein the base plate has a cylindrical pilot bore that extends from the upper surface of the base plate.

76. The system of claim 75 wherein the pilot bore is concentric with the central axis of the chuck.

77. The system of claim 71 wherein the base plate further comprises an annular finger ring around which the collar fits, and wherein the at least one finger is attached to and extends away from the finger ring by a flexible connection.

78. The system of claim 77 wherein the flexible connection is a living hinge.

79. The system of claim 71 wherein the blood bowl is hollow and may be generally conical in shape.

80. The system of claim 71 wherein the blood bowl has a pilot located on a central axis of the blood bowl that extends away from the lower base of the blood bowl.

81. The system of claim 80 wherein the base plate chuck has a cylindrical pilot bore that extends from the upper surface of the base plate and wherein the pilot bore has an inner diameter slightly larger than the outer diameter of the pilot.

82. The system of claim 71 wherein the at least one plunger bore is formed in the base plate extending radially from the central axis of the chuck.

83. The system of claim 71 wherein the at least one plunger bore extends within the base plate at an angle downward from the transverse plane.

84. The system of claim 71 wherein the at least one plunger bore extends within the base plate essentially parallel to the transverse plane.

85. The system of claim 71 wherein the at least one plunger bore extends within the base plate at an angle upward from the transverse plane.

86. The system of claim 71 further comprising a plunger wherein the at least one plunger bore has means for biasing the plunger away from the central axis.

87. The system of claim 86 wherein the means for biasing is a spring.

88. The system of claim 86 wherein the means for biasing is chosen from the group consisting of magnetic repulsion, pneumatic pressure, hydraulic pressure or gravitational force.

89. The system of claim 71 wherein the plunger capture wall includes a plunger detent located below the pressure wall and a resistance ridge formed between the pressure wall and the plunger detent.

90. A method of converting outwardly directed centrifugal forces into a downward bias on a collar comprising the steps of:

a) providing a mass capable of moving away from a first central axis under the influence of centrifugal forces;

b) providing a collar around the mass, the collar having a top and a bottom and an inwardly directed sloping surface, moving from top to bottom, the collar having a second central axis, the first and second central axes aligned when the collar is in position around the mass;

c) positioning the collar so that the mass contacts the sloping surface when the mass is acted on by centrifugal forces;

d) rotating the mass and collar around their aligned first and second central axes;

whereby, centrifugal forces acting on the mass cause the mass to move away from the first axis into contact with the sloping surface; and, whereby, contact between the mass and the sloping surface causes the collar to be biased downwardly.

91. A method of converting downward movement on a collar into a inward movement of a finger comprising the steps of:

a) providing a collar, the collar having a top and a bottom and an inwardly directed sloping surface, moving from bottom to top, the collar having a first central axis;

b) providing at least one finger, the finger rotatable around a pivot point, the finger having a sloping surface contact point and an object contact point, the sloping surface contact point contacting the sloping surface, the object contact point being generally directed toward a second central axis, the finger rotating around the pivot point in response to contact between the sloping surface and the sloping surface contact point so that the object contact point moves toward the second axis;

c) moving the collar downwardly;

whereby, contact between the sloping surface and the sloping surface contact point moves the object contact point toward the second axis.

92. A method of converting outwardly directed centrifugal forces into inward movement of a finger comprising the steps of:

a) providing a mass capable of moving away from a first central axis under the influence of centrifugal forces;

b) providing a collar around the mass, the collar having a top and a bottom, a first inwardly directed sloping surface, moving from top to bottom, and a second inwardly directed sloping surface, moving from bottom to top, the collar having a second central axis, the first and second central axes aligned when the collar is in position around the mass;

c) providing at least one finger, the finger rotatable around a pivot point the finger having a sloping surface contact point and an object contact point, the sloping surface contact point contacting the second inwardly directed sloping surface, the object contact point being generally directed toward the second central axis, the finger rotating around the pivot point in response to contact between the second inwardly directed sloping surface and the sloping surface contact point so that the object contact point moves toward the second axis;

d) positioning the collar so that the mass contacts the sloping surface when the mass is acted on by centrifugal forces;

e) rotating the mass and collar around their aligned first and second central axes;

whereby, centrifugal forces acting on the mass cause the mass to move away from the first axis into contact with the first inwardly directed sloping surface;

whereby, contact between the mass and the sloping surface causes the collar to move downwardly; and, whereby, contact between the second inwardly directed sloping surface and the sloping surface contact point moves the object contact point toward the second axis.

* * * * *